US010688814B2

(12) United States Patent
Balala et al.

(10) Patent No.: US 10,688,814 B2
(45) **Date of Patent: *Jun. 23, 2020**

(54) MEDIA TRANSPORT MECHANISM FOR PRINTER HAVING MULTIPLE PRINTHEADS

(71) Applicant: Memjet Technology Limited, Dublin (IE)

(72) Inventors: Rommel Balala, North Ryde (AU); Dan Baterna, North Ryde (AU); Billy Sy, North Ryde (AU); Christopher Hibbard, North Ryde (AU)

(73) Assignee: Memjet Technology Limited (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/267,259

(22) Filed: Feb. 4, 2019

(65) Prior Publication Data

US 2019/0168517 A1 Jun. 6, 2019

Related U.S. Application Data

(63) Continuation of application No. 15/884,242, filed on Jan. 30, 2018, now Pat. No. 10,232,647.

(Continued)

(51) Int. Cl.
*B41J 13/00* (2006.01)
*B41J 3/54* (2006.01)

(Continued)

(52) U.S. Cl.
CPC ..... *B41J 11/20* (2013.01); *B41J 2/155* (2013.01); *B41J 2/2146* (2013.01); *B41J 3/543* (2013.01);

(Continued)

(58) Field of Classification Search
CPC . B41J 2/155; B41J 2/2146; B41J 3/543; B41J 11/02; B41J 11/0085; B41J 11/20; B41J 13/0027; B41J 13/0072; B41J 13/03; B41J 2002/012; B65H 5/062; B65H 29/125; B65H 11/00; B65H 2515/30; B65H 2801/03

See application file for complete search history.

(56) References Cited

U.S. PATENT DOCUMENTS 6,394,573 B1 * 5/2002 Lapstun ..... G06K 15/10 347/19
2007/0291095 A1 * 12/2007 Wada ..... B41J 2/155 347/104
2013/0016162 A1 * 1/2013 Yasu ..... B41J 2/04581 347/68

* cited by examiner

*Primary Examiner* — Anh T Vo
(74) *Attorney, Agent, or Firm* — Cooley LLP

(57) ABSTRACT

A printer includes: a first fixed printhead; a second fixed printhead positioned downstream of the first printhead relative to a media feed direction; a platen for supporting print media; an input media transport mechanism positioned upstream of the first printhead, the input media transport mechanism exerting a gripping force $N_1$ on print media; an output media transport mechanism positioned downstream of the second printhead, the output media transport mechanism exerting a gripping force $N_2$ on print media; and an intermediary media transport mechanism positioned between the first and second printheads, the intermediary media transport mechanism exerting a gripping force $N_3$ on print media. The gripping forces satisfy the relationship $N_1>N_2>N_3$ for optimal printing results.

13 Claims, 1 Drawing Sheet

Related U.S. Application Data

(60) Provisional application No. 62/453,960, filed on Feb. 2, 2017.

(51) Int. Cl.

| | |
|---|---|
| ***B65H 5/06*** | (2006.01) |
| ***B65H 29/12*** | (2006.01) |
| ***B41J 11/20*** | (2006.01) |
| ***B65H 11/00*** | (2006.01) |
| ***B41J 11/00*** | (2006.01) |
| ***B41J 2/155*** | (2006.01) |
| ***B41J 11/02*** | (2006.01) |
| ***B41J 2/21*** | (2006.01) |
| ***B41J 13/03*** | (2006.01) |
| *B41J 2/01* | (2006.01) |

(52) U.S. Cl.

CPC ..... *B41J 11/0085* (2013.01); *B41J 11/02* (2013.01); *B41J 13/0027* (2013.01); *B41J 13/0072* (2013.01); *B41J 13/03* (2013.01); *B65H 5/062* (2013.01); *B65H 11/00* (2013.01); *B65H 29/125* (2013.01); *B41J 2002/012* (2013.01); *B65H 2515/30* (2013.01); *B65H 2801/03* (2013.01)

MEDIA TRANSPORT MECHANISM FOR PRINTER HAVING MULTIPLE PRINTHEADS

CROSS-REFERENCE TO RELATED APPLICATIONS

This application is a Continuation application of U.S. application Ser. No. 15/884,242 filed on Jan. 30, 2018, which claims the benefit of priority of U.S. Provisional Application No. 62/453,960 filed on Feb. 2, 2017.

FIELD OF THE INVENTION

This invention relates to a roller feed mechanism for a printer. It has been developed primarily for feeding sheets of print media at high-speed past a plurality of fixed printheads.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

High-speed, single-pass inkjet printing requires accurate media handling, especially in the print zone of the printhead, in order to provide acceptable print quality. With fixed printheads of a given length, relatively wide print zones may be constructed by arranging printheads in a staggered overlapping array across the print zone. For example, an A3 print zone may be constructed by positioning a pair of A4 printheads in a staggered overlapping arrangement.

For relatively narrow print zones (e.g. A4 size or narrower), a system of entry and exit rollers in combination with a fixed media platen generally provides sufficient stability in the print zone for acceptable print quality (see, for example, U.S. Pat. No. 8,523,316, the contents of which are herein incorporated by reference).

However, for wider media widths and/or faster print speeds, more complex media feed mechanisms are usually required. For example, U.S. Pat. No. 8,540,361 describes a feed mechanism suitable for wideformat printing comprising a combination of a fixed vacuum platen, an upstream drive roller and a downstream vacuum belt mechanism. The printer described in U.S. Pat. No. 8,540,361 employs five printhead modules arranged in a staggered overlapping array across the print zone.

In other high-speed printers, vacuum belt mechanisms may be employed for driving print media through the print zone. However, vacuum belt mechanisms, which transport media through the print zone, are problematic for inkjet printing, because the belt may become fouled with ink during printing (e.g. adventitious ink mist or paper dust generated during high-speed printing). Moreover, inkjet printheads typically perform a number of inter-page spits so as to reduce the frequency of maintenance interventions and endless belts are not amenable to inter-page spitting due to ink fouling the belt.

It would be desirable to provide a printer having a feed mechanism suitable for feeding sheets of print media through print zones defined by a plurality of overlapping printheads.

SUMMARY OF THE INVENTION

In a first aspect, there is provided a printer comprising:

a first fixed printhead having a respective first print zone;

a second fixed printhead positioned downstream of the first printhead relative to a media feed direction, the second printhead having a respective second print zone;

at least one fixed platen for supporting print media in the first and second print zones;

an input roller assembly positioned upstream of the first printhead, the input roller assembly comprising a pair of input rollers having a first nip force $N_1$ therebetween;

an output roller assembly positioned downstream of the second printhead, the output roller assembly comprising a pair of output rollers having a second nip force $N_2$ therebetween; and an intermediary roller assembly positioned between the first and second printheads, the intermediary roller assembly comprising a pair of intermediary rollers having a third nip force $N_3$ therebetween, wherein $N_1>N_2>N_3$.

The printer according to the first aspect advantageously provides a roller feed mechanism for feeding print media past a plurality of printheads aligned in the media feed direction. In particular, undesirable speed variations are minimized by virtue of the relationship between the nip forces $N_1$, $N_2$ and $N_3$.

Preferably, the first and second printheads are positioned in an overlapping arrangement with respect to the media feed direction. Preferably, the printheads are inkjet printheads and may comprise a plurality of printhead chips based on pagewide printing technology.

Preferably, the platen extends between the first and second printheads and defines a common surface for supporting print media in the first and second print zones.

Preferably, the input roller assembly is positioned upstream of the platen, the output roller assembly is positioned downstream of the platen and the intermediary roller assembly has one intermediary roller embedded in the platen.

Preferably, the platen provides a planar trajectory for print media passing through the first and second print zones. For example, the trajectory may be horizontal.

Preferably, the platen is a vacuum platen.

Preferably, the input, output and intermediary roller assemblies have respective drive rollers operatively connected to a common drive mechanism.

Preferably, the printer satisfies one or more of the following:

$$N_1>(N_2+N_3);$$

$$N_1>2N_2;$$

$$N_1>5N_2;$$

$$N_1>10N_2;$$

$$N_2>2N_3;$$

$N_1$ is in the range of 10 to 60 Newtons;

$N_2$ is in the range of 1 to 5 Newtons; and $N_3$ is in the range of 0.3 to 2 Newtons.

In one embodiment, one or more of $N_1$, $N_2$ and $N_3$ are variable within predetermined operating parameters of the printer. For example, the nip forces for one or more of $N_1$, $N_2$ and $N_3$ may be dependent, at least partially, on a stiffness of print media used for printing. Further, the printer may be configurable to associate a predetermined media type with predetermined nip forces for $N_1$, $N_2$ and $N_3$.

In one embodiment, relatively higher nip forces for $N_2$ and/or $N_3$ are employed for relatively stiffer print media.

As used herein, the term "printer" refers to any printing device for marking print media, such as conventional desktop printers, label printers, duplicators, copiers and the like. In one embodiment, the printer is a sheet-fed printing device.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
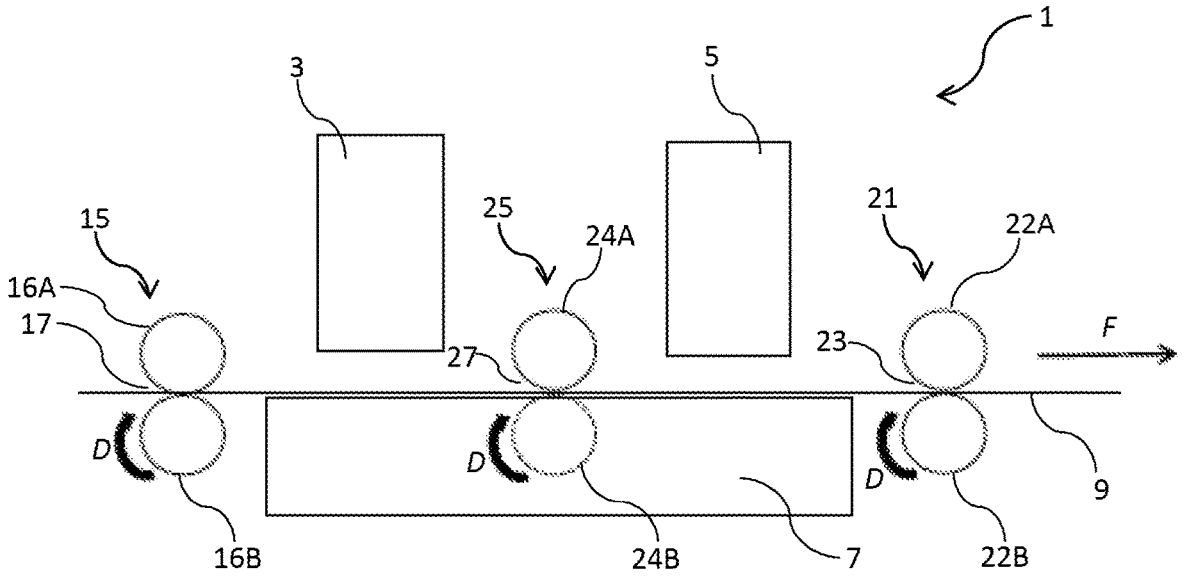
FIG. 1 is a schematic side view of a printer with printheads and roller assemblies according to the first aspect.

Referring to FIG. 1, there is shown a printer 1 comprising a first fixed printhead 3 and a second fixed printhead 5 positioned downstream of the first printhead relative to a media feed direction F. A fixed vacuum platen 7 is positioned for supporting sheets of print media 9 (e.g. paper) fed through respective print zones of the first and second printheads 3 and 5. The platen 7 has a planar upper surface such that print media are fed in a horizontal trajectory past the first and second printheads 3 and 5. The vacuum platen 7 provides a suction force for print media passing over the platen. Accordingly, print media are stably supported flat against the vacuum platen 7 as the media travels through the spaced apart print zones of respective printheads printheads. Vacuum platens are well known to those skilled in the art and comprise, for example, an internal vacuum plenum connected to a vacuum source and an apertured upper surface communicating with the vacuum plenum (not shown).

Figure 2:
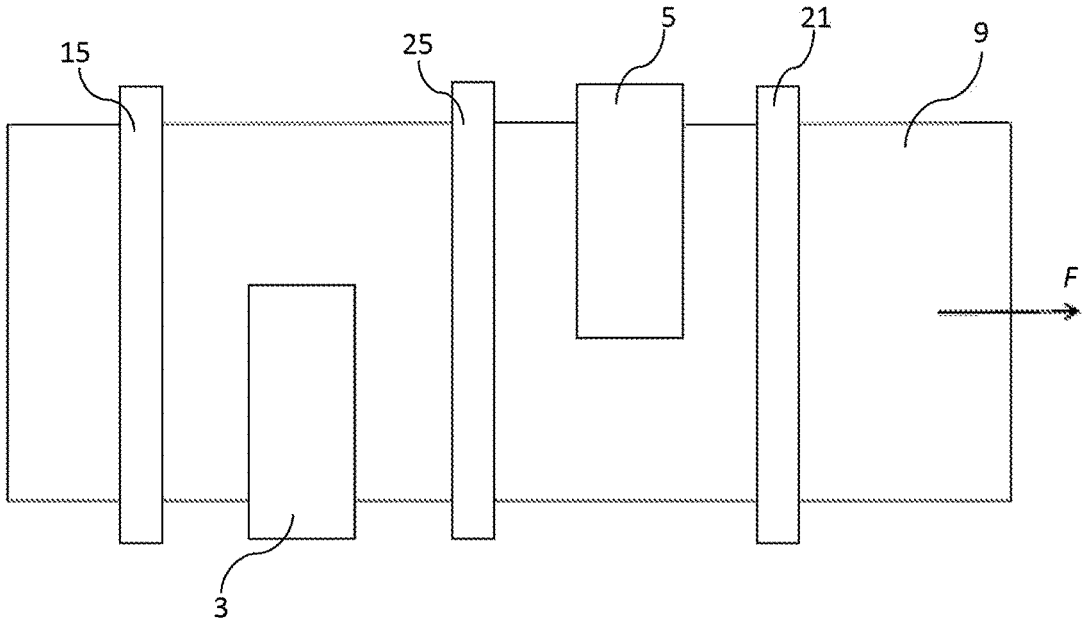
FIG. 2 is a schematic plan view of the printer shown in FIG. 1.

As shown in FIG. 2, the first printhead 3 and the second printhead 5 partially overlap in the media feed direction F, with each printhead printing about half of the image (not shown). Suitable algorithms may be employed to mask any stitching artifacts between the two printheads using techniques known in the art (see, for example, U.S. Pat. No. 6,394,573, the contents of which are incorporated herein by reference). Accordingly, a pair of overlapping A4-sized printheads may, for example, be used to print onto A3 sheets.

An input roller assembly 15 is comprised of a pair of input rollers positioned upstream of the vacuum platen 7. The input roller assembly 15 receives a leading edge of the media sheet 9 and is configured to feed the sheet along the media feed direction F towards the print zone of the first printhead 3. The input roller assembly 15 defines a first nip 17 between an upper input idler roller 16A engaged with a lower input drive roller 16B. The first nip has a corresponding first nip force $N_1$.

An output roller assembly 21 is comprised of a pair of output rollers positioned downstream of the platen 7 relative to the media feed direction F. The output roller assembly 21 is configured for receiving the media sheet 9 from the vacuum platen 7 and transporting the sheet into an exit tray (not shown) of the printer 1. The output roller assembly 21 defines a second nip 23 between an upper output idler roller 22A engaged with a lower input drive roller 22B. The second nip has a corresponding first nip force $N_2$.

An intermediary roller assembly 25 is embedded at least partially within the vacuum platen 7 and is comprised of a pair of intermediary rollers (e.g. star wheels) positioned between the first printhead 3 and the second printhead 5. The intermediary roller assembly 25 is configured for receiving the media sheet 9 from the first input roller assembly 15 and feeding the sheet towards the output roller assembly 21 past the second printhead 5. The intermediary roller assembly 25 defines a third nip 27 between an upper intermediary idler roller 24A engaged with a lower intermediary drive roller 24B (shown in dashed outline) embedded in the platen 7. The third nip 27 has a corresponding first nip force $N_3$.

The input roller assembly 15, intermediary roller assembly 25 and output roller assembly 21 together form part of a media feed mechanism of the printer 1. The media feed mechanism may comprise other components, such as a media picker (not shown), as is known in the art. Further, each roller assembly may comprise a single roller extending across a media width or multiple rollers spaced apart across the media width.

Although the vacuum platen 7 assists in maintaining media sheets flat through the print zones of the first and second printhead 3 and 5, the application of suction results in the media sheets being relatively more difficult to drive across the platen. Hence, the intermediary roller assembly 25 having the third nip 27 assists in driving media sheets 9 from the first nip 17 towards the second nip 23.

Preferably, each of the roller assemblies 15, 25 and 21 comprise a respective drive roller (drive rollers 16B, 24B and 22B) operatively connected to a common drive mechanism indicated by arrow D. For example, an endless belt (not shown) may be employed as a common drive mechanism for driving all drive rollers at a nominally constant speed.

Notwithstanding the use of a common drive mechanism for each of the drive rollers 16B, 24B and 22B, the introduction of the intermediary drive roller 24B in the feed mechanism creates the potential for slight speed variations as the media sheet 9 is handed off between the various roller assemblies. Any slight variations in speed will cause print artifacts and are highly undesirable.

Accordingly, the drive roller assembly 15 is configured such that the first nip force $N_1$ is greater than both the third nip force $N_3$ and the second nip force $N_2$. Hence, the first drive roller 16B dominates and controls the velocity of the print media 9 when any part of the print media is engaged in the first nip 17. If, for example, the first nip 17 is travelling faster than third nip 27, the first nip can simply push the print media 9 through the third nip. On the other hand, if the third nip is travelling faster than first nip 17, then the third nip 17 will tension the print media 9, but will not be able to pull the print media faster than the speed of the first nip.

A similar relationship exists between the second nip 23 of the output roller assembly 21 and the third nip 27. Thus, the second nip force $N_2$ is configured to be greater than the third nip force $N_3$, but less than the first nip force $N_1$. Accordingly, when the print media 9 is engaged with the first nip 17, the first nip speed controls the velocity of the print media over the vacuum platen 7. However, when a trailing edge of the print media 9 has disengaged from the first nip 17, then the second nip speed controls the speed of the print media. In this way, the intermediary roller assembly 25 assists with transport of the print media 9 over the vacuum platen 7, but does not influence the relationship between the input and output roller assemblies 15 and 21.

Preferably, $N_1$ is greater than $N_2$ and $N_3$ combined in order to achieve optimal printing results. In one setup, $N_1$=56 N; $N_2$=3.1 N; and $N_3$=0.8 N. However, it will be appreciated that the values of $N_1$, $N_2$ and $N_3$ may be adjusted by the person skilled in the art in order to achieve optimal printing results. Ideally, the print media 9 should act as a rigid body under each print zone and this rigidity is dependent on, for example, the stiffness of the print media, the amount of suction force from the vacuum platen, the relative nip forces in the feed mechanism, the distance between nips etc. One or more of the input, output and intermediary rollers may be spring-mounted and the spring tensions suitably adjusted in order to optimize printing conditions within the ambit of the present invention.

In particular, the nip forces $N_2$ and $N_3$ should be minimized to the extent possible in order to minimize the possibility of buckling when the print media 9 is under the control of the input roller assembly 15. However, at least some nip force must be maintained in order to drive the print media 9 across the vacuum platen 7. In some embodiments, the nip forces $N_1$, $N_2$ and $N_3$ may be varied in order to optimize printing conditions for different media types having a different stiffness. For example, a predetermined media type may invoke predetermined nip force settings in the printer, as appropriate (e.g. via manual entry of a media type via a user interface, barcode sensing of media or media packaging etc.). Typically, relatively stiffer media types tolerate higher values of $N_2$ and $N_3$ due to the lesser tendency for buckling with stiffer print media. Conversely, relatively less stiff print media required lower values of $N_2$ and $N_3$ due to the greater tendency for buckling with such print media.

The vacuum platen 7 may be liftable towards and away from the printheads 3 and 5 to enable capping and/or maintenance interventions when required, or to clear paper jams. A suitable arrangement for lifting and translating a platen to enable maintenance and/or capping interventions is described in U.S. Pat. No. 8,523,316, the contents of which are incorporated herein by reference. Additionally or alternatively, each printhead 3 and 5 be liftable towards and away from the platen 7. A suitable arrangement for lifting and translating a printhead to enable maintenance and/or capping interventions is described in U.S. Pat. No. 9,061,531, the contents of which are incorporated herein by reference.

Although the present invention has been described with reference to two overlapping fixed printheads, it will of course be appreciated that the invention may be applicable to any number of printheads (e.g. three or more) arranged along a media feed path, irrespective of whether the printheads are overlapping, non-overlapping or aligned. For example, additional third and fourth printheads may be positioned between the first and second printheads, with an intermediary roller positioned between each printhead in the sequence. These and other arrangements having three or more printheads are within the ambit of the present invention.

It will, of course, be appreciated that the present invention has been described by way of example only and that modifications of detail may be made within the scope of the invention, which is defined in the accompanying claims.

What is claimed is:

1. A printer comprising:

a first fixed printhead having a respective first print zone;

a second fixed printhead positioned downstream of the first printhead relative to a media feed direction, the second printhead having a respective second print zone;

at least one platen for supporting print media in the first and second print zones;

an input media transport mechanism positioned upstream of the first printhead, the input media transport mechanism exerting a gripping force $N_1$ on print media;

an output media transport mechanism positioned downstream of the second printhead, the output media transport mechanism exerting a gripping force $N_2$ on print media; and an intermediary media transport mechanism positioned between the first and second printheads, the intermediary media transport mechanism exerting a gripping force $N_3$ on print media, wherein $N_1>N_2>N_3$.

2. The printer of claim 1, wherein the first and second printheads are positioned in an overlapping arrangement with respect to the media feed direction.

3. The printer of claim 1, wherein the platen is a fixed platen extending between the first and second printheads and defines a common surface for supporting print media in the first and second print zones.

4. The printer of claim 3, wherein the input media transport mechanism is positioned upstream of the platen and the output media transport mechanism is positioned downstream of the platen and the intermediary media transport mechanism is at least partially embedded in the platen.

5. The printer of claim 1, wherein the platen provides a planar trajectory for print media passing through the first and second print zones.

6. The printer of claim 1, wherein $N_1>(N_2+N_3)$.

7. The printer of claim 1, wherein $N_1>2N_2$.

8. The printer of claim 1, wherein $N_2>2N_3$.

9. The printer of claim 1, wherein:

$N_1$ is in the range of 10 to 60 Newtons;

$N_2$ is in the range of 1 to 5 Newtons; and $N_3$ is in the range of 0.3 to 2 Newtons.

10. The printer of claim 1, wherein one or more of $N_1$, $N_2$ and $N_3$ are variable within predetermined operating parameters of the printer.

11. The printer of claim 1, wherein $N_1$, $N_2$ and $N_3$ are dependent, at least partially, on a stiffness of print media used for printing.

12. The printer of claim 11, wherein relatively higher gripping forces for $N_2$ and/or $N_3$ are employed for relatively stiffer print media.

13. The printer of claim 1 which is configurable to associate a predetermined media type with predetermined gripping forces for $N_1$, $N_2$ and $N_3$.

* * * * *